US006058745A

United States Patent [19]

Sanchez

[11] Patent Number: 6,058,745

[45] Date of Patent: May 9, 2000

[54] COVER FOR PADLOCKS

[76] Inventor: Terry L. Sanchez, 204 Victor Dr., Blue Springs, Mo. 64014

[21] Appl. No.: 09/334,199

[22] Filed: Jun. 16, 1999

[51] Int. Cl.[7] ..... E05B 67/38

[52] U.S. Cl. ..... 70/56; 70/417; 70/DIG. 43; 70/DIG. 56

[58] Field of Search ..... 70/54–56, 417, 70/DIG. 43, DIG. 56

[56] References Cited

U.S. PATENT DOCUMENTS

| | | | |
|---|---|---|---|
| 256,902 | 4/1882 | Kirk | 70/56 |
| 547,550 | 10/1895 | Hopkins | 70/56 |
| 2,766,605 | 10/1956 | O'Brien | 70/417 |
| 3,590,607 | 7/1971 | Beaver | 70/56 |
| 3,727,438 | 4/1973 | Knaack | 70/56 X |
| 4,033,156 | 7/1977 | Cottingham | 70/56 |
| 4,290,281 | 9/1981 | Knaack et al. | 70/54 |
| 4,438,641 | 3/1984 | Levkov | 70/417 X |
| 4,576,022 | 3/1986 | Gamble | 70/417 X |
| 4,882,918 | 11/1989 | Stanich | 70/56 X |
| 4,896,518 | 1/1990 | Appelgren | 70/54 |
| 4,898,008 | 2/1990 | Eberly | 70/56 |
| 5,076,078 | 12/1991 | Weger, Jr. | 70/54 |
| 5,168,258 | 12/1992 | Radke | 70/54 X |
| 5,477,710 | 12/1995 | Stefanutti | 70/56 |
| 5,737,946 | 4/1998 | Sole et al. | 70/54 |
| 5,743,118 | 4/1998 | Anderson | 70/56 |

*Primary Examiner*—Lloyd A. Gall
*Attorney, Agent, or Firm*—Litman, Kraai & Brown L.L.C.

[57] ABSTRACT

A padlock cover assembly for use in latching and locking doors includes a cover with a peripheral wall. The cover is pivotally mounted to a pivot base which is pivotally mounted to a first door member by a pivot pin. The cover is pivotal relative to the pivot base into and out of covering relationship with a padlock supported by its shackle on a padlock mounting bracket secured to the second door member. A pawl is formed on the cover and sized and positioned such that the pawl is advanceable between the shackle and an upper surface of a padlock body when the cover is advanced into covering relationship with the padlock supported on the mounting bracket in an unlocked condition. The cover is then pivotable about the pivot pin such that a portion of the peripheral wall of the cover engages a bottom of the padlock body advancing the padlock body toward the shackle and into a closed condition. As the cover is pivoted to advance the padlock to the closed condition, the pawl extends into interlocking engagement with the shackle of the padlock. An access opening is formed in the peripheral wall of the cover to provide access to a keyhole in the padlock.

16 Claims, 2 Drawing Sheets

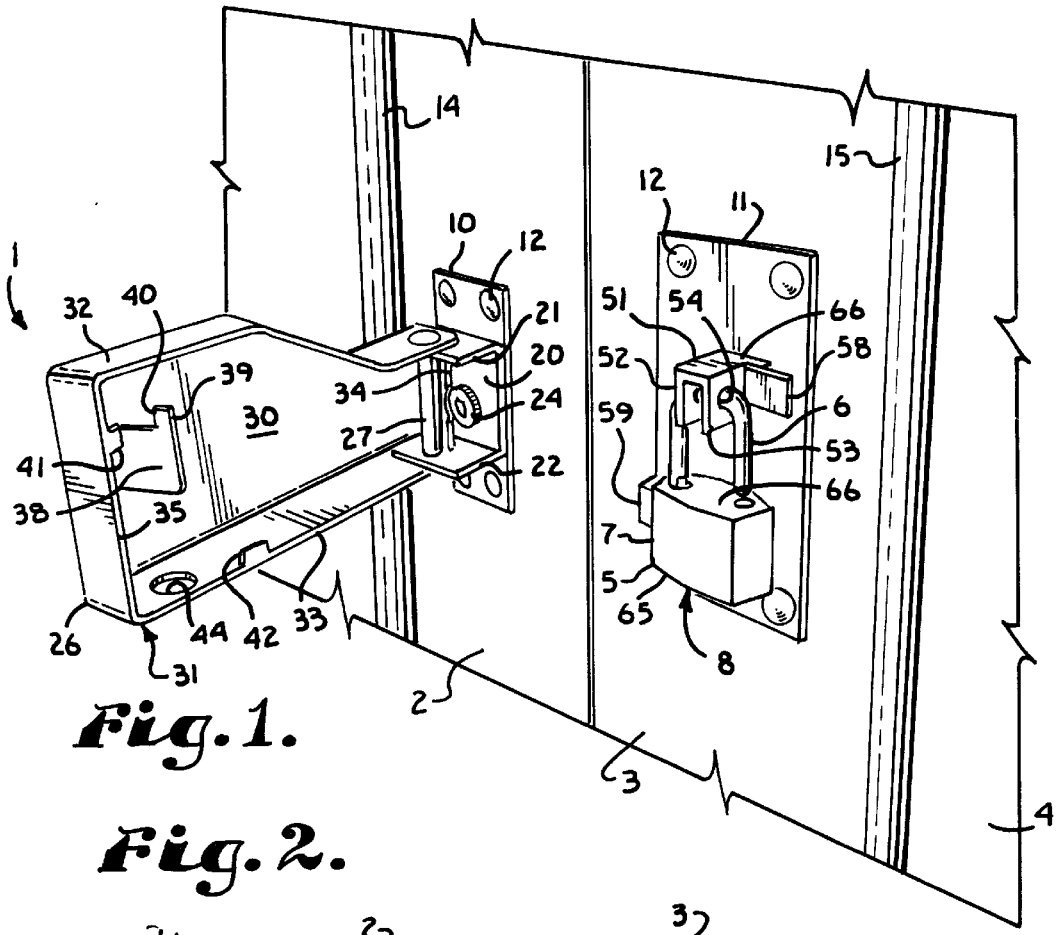
Fig. 1.
Fig. 2.
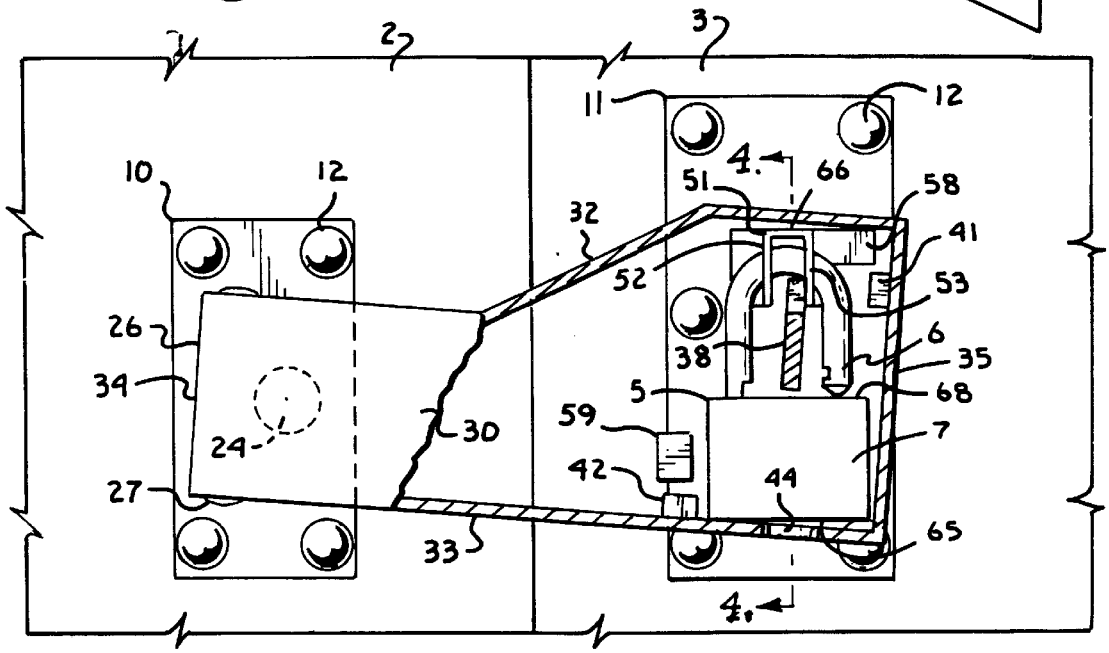

COVER FOR PADLOCKS

BACKGROUND OF THE INVENTION

The present invention relates to covers for padlocks and in particular a cover which functions in part as a latch in combination with a padlock for securing doors in a closed position and as a cover for preventing access to the lock except for the keyhole.

Padlocks are often used in combination with a latch or hasp to lock shut doors such as the doors of a tractor trailer. However, with a standard latch or hasp, the shackle of the padlock is generally exposed. A thief with a pair of bolt cutters can easily gain access to the contents of a tractor trailer or the like by using the bolt cutters to quickly cut through an exposed shackle of a padlock. Numerous attempts have been made to develop covers or protective devices for padlocks which limit a thief's access to the padlock shackle. Despite such efforts, there remains a need for a cover for padlocks which limits access to the padlock to prevent tampering and which is adapted for use with a wide range of doors and in particular tractor trailer doors.

SUMMARY OF THE INVENTION

The present invention comprises a padlock cover assembly for latching and locking shut doors, such as tractor trailer doors. The padlock cover assembly comprises a cover having a peripheral wall. The cover is pivotally mounted at a first end to a first door member such that a second end of the cover is pivotable into and out of covering relationship with a padlock mounted on a padlock mounting bracket on a second door member. When the cover is positioned in covering relationship with the padlock, the peripheral wall generally encloses the padlock. A latch member or pawl is mounted on an inner surface of the cover and sized and positioned to extend between the shackle of the padlock and an upper surface of the padlock body when the cover is advanced into covering relationship with a padlock secured on the padlock mounting bracket in an unlocked condition.

With the cover positioned in covering relationship with the padlock supported on the padlock mounting bracket in an unlocked condition, the cover is advanceable relative to the padlock, such as through pivoting or sliding, such that a portion of the peripheral wall of the cover engages a bottom surface of the padlock body and pushes the padlock body toward the shackle and into a locked condition therewith. As the cover is advanced to push the padlock into a locked condition, the pawl is advanced into interlocking relationship with the shackle of the padlock to prevent removal of the cover from covering relationship with the padlock. An access hole is formed in the peripheral wall of the cover and positioned to provide access to a keyhole in the padlock with a key when the cover is positioned in covering relationship over the padlock in the locked condition.

First interlocking members are also formed on the cover and advanceable into interlocking engagement with second interlocking members on the second door member when the cover is advanced in covering relationship with the padlock from the unlocked condition to the locked condition.

OBJECTS AND ADVANTAGES OF THE INVENTION

The objects of this invention include: providing a tamper resistant latching mechanism for doors; providing such a latching mechanism which utilizes a padlock and which limits access to the padlock; to provide such a latching mechanism which covers the padlock when in a locked condition; to provide such a latching mechanism which is relatively inexpensive to manufacture and relatively easy to install; and to provide such a latching mechanism which is particularly well adapted for its intended uses.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a fragmentary perspective view of a padlock cover assembly secured to doors of a tractor trailer having a cover shown pivoted away from a padlock of the assembly.

FIG. 2 is an enlarged and fragmentary front elevational view of the padlock cover assembly showing the cover in covering relationship with the padlock which is unlocked, with portions of the cover removed to show interior detail thereof.

DETAILED DESCRIPTION OF THE INVENTION

Figure 3:
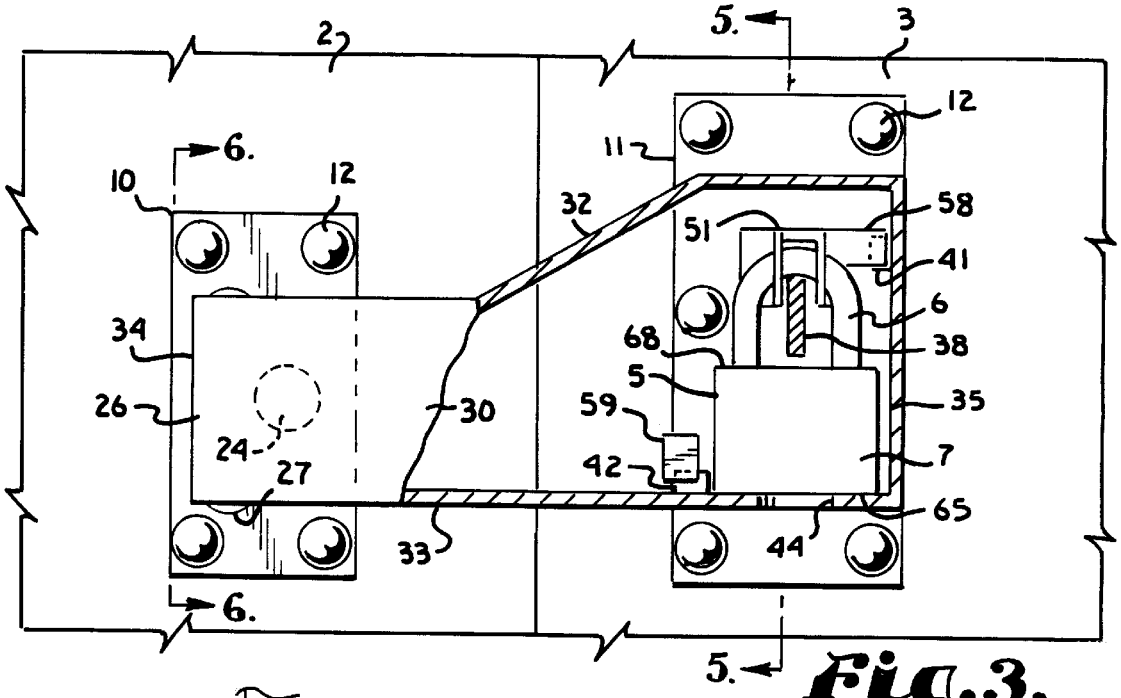
FIG. 3 is a view similar to FIG. 2 showing the cover and the padlock in a locked orientation.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally refers to a padlock cover assembly of the present invention shown secured to and extending between a pair of doors or first and second doors 2 and 3 of a tractor trailer 4 and adapted for use in combination with a padlock 5 for locking the doors closed and to protect the padlock 5 from tampering. The padlock 5 includes a shackle 6 and padlock body 7 with a keyhole 8 formed therein.

The padlock cover assembly 1 generally comprises a first mounting plate 10 and a second mounting plate 11 which are bolted to the first and second door 2 and 3 respectively by bolts 12 extending through the mounting plates 10 and 11 and doors 2 and 3. In a preferred embodiment as shown in FIG. 1, the padlock cover assembly 1 is sized such that the mounting plates 10 and 11 are mounted or extend between rods 14 and 15 associated with the tractor trailer doors 2 and 3.

A pivot or swivel base 20, having upstanding legs 21 and 22, is pivotally mounted to the first mounting plate 10 by pivot bolt 24. Cover 26 is pivotally connected to the pivot base 20 by pivot or hinge pin 27. Cover 26 comprises cover plate 30 and peripheral flange 31. The peripheral flange 31 generally includes top wall 32, bottom wall 33, first end wall 34 and second end wall 35. The cover 26 is connected to the pivot base 20 such that the top and bottom walls 32 and 33 of the peripheral wall 31 extend adjacent and over the upstanding legs 21 and 22 of the pivot base 20 with the pivot pin 27 extending through the top and bottom walls 32 and 33 and the upstanding legs 21 and 22.

Figure 6:
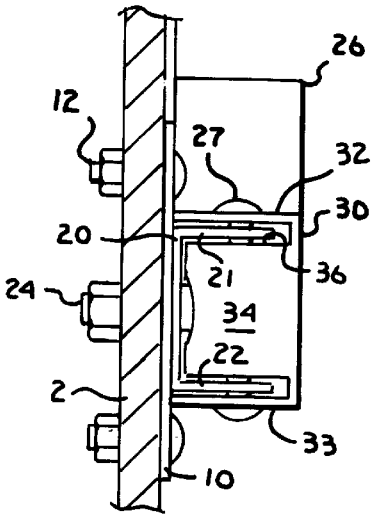
FIG. 6 is a fragmentary cross-sectional view taken along line 6—6 of FIG. 3.

Referring to FIG. 6, slots 36 are formed between the first end wall 34 and the top and bottom walls 32 and 33 in alignment with and slightly wider than the upstanding legs 21 and 22 of the pivot or swivel base 20 to permit the first end wall 34 to pass between the upstanding legs 21 and 22 of the pivot base 20 when the cover 26 is pivoted away from the second mounting plate 11 and to prevent the first end wall 34 from interfering with opening of the cover 26.

A latch member or pawl 38 is welded to an inner surface of cover plate 30. The latch member 38 includes a latch finger 39 formed on a distal end thereof which extends toward top wall 32 such that a notch 40 is generally formed between the latch finger 39 and an inner surface of the cover plate 30. A first tab 41 is secured to and extends inward from the second end wall 35 in parallel planar alignment with the cover plate 30. Similarly, a second tab 42 is secured to and extends inward from bottom wall 33 in parallel planar alignment with the cover plate 30. The first and second tabs 41 and 42 may also be referred to as first interlocking members. An access hole 44 is formed in the bottom wall 33.

The second mounting plate 11 has a padlock mounting bracket or clevis 51 secured thereto having spaced apart legs 52 and 53 with aligned apertures 54 extending therethrough. First and second shoulders 58 and 59 (FIGS. 1–3) or second interlocking members are formed in or secured to the second mounting plate 11 and positioned for overlapping engagement with the first and second tabs 41 and 42 on cover 26 as discussed in more detail below.

To use the padlock cover assembly 1 to secure doors 2 and 3 in a closed position, the cover 26 is first pivoted away from the second mounting plate 11 about an axis extending through the hinge pin 27 which extends parallel to an outer surface of the first door 2. With the padlock 5 unlocked, the shackle 6 is extended through the aligned apertures 54 in the legs 52 and 53 of clevis 51 such that the padlock body 7 hangs below the clevis 51.

The cover 26 is then pivoted about the hinge pin 27 over the padlock 5. The top and bottom walls 32 and 33 proximate the second end wall 35 are spaced apart a distance slightly greater than the distance between a bottom surface 65 of the padlock body 7 and an upper surface or wall 66 of the clevis 51 such that the cover 26 fits over the padlock 5. To position the cover 26 over the padlock 5 in the unlocked position, the cover 26 must be pivoted about the pivot pin 27 toward the second door 3 and also about an axis extending through the pivot bolt 24 so as to be angled slightly below horizontal. The axis extending through the pivot bolt 24 generally extends transverse or perpendicular to the axis extending through the hinge pin 27.

As shown in FIG. 2, when the cover 26 is positioned in covering relationship with the unlocked padlock 5, the first tab 41 extends below or is offset relative to the first shoulder 58, and the second tab 42 extends below or is offset relative to the second shoulder 59. As further shown in FIG. 2, the latch member 38 including the latch finger 39 extends between an upper surface 68, of the padlock body 7 and the shackle 6 at the peak or bight thereof and partially between the legs 52 and 53 of clevis 51. Further, with the cover 26 in covering relationship with the unlocked padlock 5, the access hole 44 in bottom wall 33 is generally aligned with the keyhole 8 of padlock 5.

Figure 4:
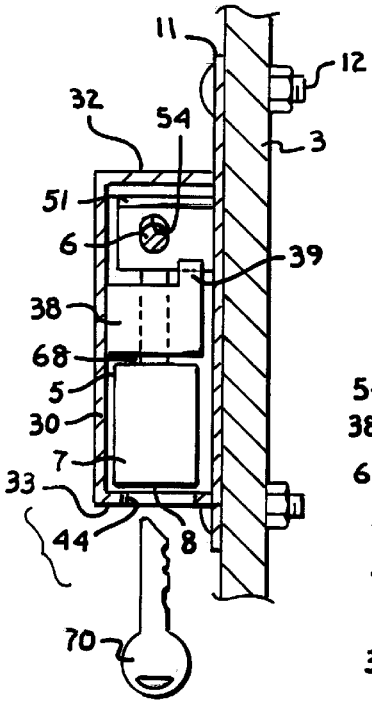
FIG. 4 is a fragmentary cross-sectional view taken along line 4—4 of FIG. 2 also showing a key associated with the padlock.
Figure 5:
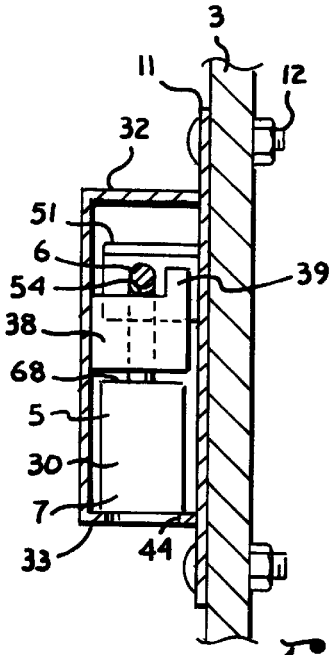
FIG. 5 is a fragmentary cross-sectional view taken along line 5—5 of FIG. 3.

To lock the padlock 5 and secure the cover 26 in place, the cover 26 is pivoted slightly upward about the pivot bolt 24 from the orientation shown in FIGS. 2 and 4 to that shown in FIGS. 3 and 5. As the cover 26 is pivoted upward, the bottom wall 33 abuts against the bottom surface 65 of the padlock body 7, pushing the padlock body 7 toward the shackle 6 and into interlocking relationship therewith. When the cover is pivoted to advance the padlock 5 to a locked position, the latch finger 39 is advanced between the shackle 6 and the second mounting plate 11 with the peak or bight of the shackle 6 generally extending into notch 40 of the latch member 38. As the cover 26 is pivoted upward as discussed, the first and second tabs 41 and 42 are advanced behind the first and second shoulders 58 and 59 respectively, such that the first and second shoulders 58 and 59 extend in overlapping or interlocking relationship with the first and second tabs 41 and 42 respectively. The overlapping relationship of the first and second shoulders 58 and 59 with the first and second tabs 41 and 42 respectively and the peak of the shackle 6 with the latch finger 39 of latch member 38 prevents the cover 26 from being pivoted away out of covering relationship with the padlock 5 and thereby latching shut the first and second doors 2 and 3. The peripheral flange 31 prevents access to the padlock shackle 6 with bolt cutters or the like to discourage thieves from attempting to unlock the doors 2 and 3.

The access hole 44 through bottom wall 33 provides access to the keyhole 8 of padlock 5 to permit access thereto of a key 70 to permit unlocking of the padlock 5. The internal spring force exerted between the shackle 6 and the padlock body 7 is sufficient to urge the padlock body 7 to an unlocked position relative to the shackle 6 and pivot the cover 26 downward toward a position as shown in FIG. 2 wherein the tabs 41 and 42 are advanced out of overlapping relationship with the shoulders 58 and 59 and the latch finger 39 is advanced out of overlapping relationship with the shackle 6, such that the cover 26 may be pivoted away from the padlock 5 and second mounting plate 11.

It is to be understood that while certain forms of the present invention have been illustrated and described herein, it is not to be limited to the specific forms or arrangement of parts described and shown.

For example, it is foreseen that instead of mounting cover 26 on pivot base 20 to pivot about pivot pin 24, the base 20 could have a vertically extending slot formed therein, through which pin 24 extends, to permit the base 20 and cover 26 to be slid vertically relative to pin 24. The sliding action of the cover 26 relative to door 2 could be used in a fashion similar to the pivoting of the cover 26 described above such that sliding of the lower wall 33 of the cover 26 upward urges the padlock body 7 upward from an unlocked condition to a locked condition relative to the shackle 6.

It is foreseen that the cover 26 and the peripheral wall could be of a wide range of shapes and it is foreseen that the peripheral wall could include notches, indentations, cut-outs and the like to accommodate projections or structure extending outward from outer surfaces of the doors or the like.

It should also be understood that although the cover assembly 1 is shown in use with a pair of tractor trailer doors 2 and 3, it is foreseen that the padlock cover assembly could be adapted for use with a wide range of types of doors and related members or structure in a wide range of orientations. For example, the padlock cover assembly 1 could be adapted for use with a single door mounted in a frame wherein the first mounting plate and cover are secured to the frame of the door and the second mounting plate and padlock mounting bracket are mounted to the door or vice versa. The padlock cover assembly 1 could also be utilized with gates with the first mounting plate and cover secured to a stationary post of the gate and the second mounting plate and padlock mounting bracket secured to the end of the gate.

What is claimed and desired to be secured by Letters Patent is as follows:

1. A padlock cover assembly for use with a padlock having a shackle and a padlock body; said assembly adapted for releasably latching and locking first and second members in cooperation with said padlock, at least one of said first and second members being moveable relative to the other; said assembly comprising:

a) a padlock mounting bracket adapted to be secured to and extend from said first member and adapted for supporting said shackle of said padlock;

b) a cover including a peripheral wall; said cover adapted to be secured to said second member so as to be advanceable into and out of covering relationship with said padlock secured to said mounting bracket by said shackle; and c) said cover having a first interlocking member secured thereto; said first interlocking member positioned on said cover such that when said cover is advanced into covering relationship with said padlock secured to said mounting bracket in an unlocked condition, said first interlocking member is positionable proximate a second interlocking member adapted to be secured to said first member; said cover, in said covering relationship with said padlock, advanceable relative to said padlock such that a portion of said peripheral wall engages said padlock body and advances said padlock body toward said shackle to advance said padlock to a locked condition and such that said first interlocking member is advanced into interlocking relationship with said second interlocking member to prevent advancement of said cover out of covering relationship with said padlock.

2. The padlock cover assembly as in claim 1 wherein:

a) a keyhole access opening is formed in said peripheral wall so as to provide access to a keyhole of said padlock when said cover is positioned in covering relationship with said padlock in said locked condition.

3. The padlock cover assembly as in claim 1 in combination with said padlock.

4. A padlock cover assembly for use with a padlock having a shackle and a padlock body; said assembly adapted for releasably latching and locking first and second members in cooperation with said padlock, at least one of said first and second members being moveable relative to the other; said assembly comprising:

a) a padlock mounting bracket adapted to be secured to and extend from said first member and adapted for supporting said shackle of said padlock;

b) a cover including a peripheral wall; said cover adapted to be secured to said second member so as to be advanceable into and out of covering relationship with said padlock secured to said mounting bracket by said shackle; and c) said cover having a pawl secured to an inner surface thereof and sized such that said pawl advances between said shackle and an upper surface of said padlock body when said cover is advanced into covering relationship with said padlock secured to said mounting bracket in an unlocked condition; said cover, in said covering relationship with said padlock, advanceable relative to said padlock such that a portion of said peripheral wall engages said padlock body and advances said padlock body toward said shackle to advance said padlock to a locked condition and such that said pawl is advanced into interlocking relationship with said shackle to prevent advancement of said cover out of covering relationship with said padlock.

5. The padlock cover assembly as in claim 4 wherein:

a) a keyhole access opening is formed in said peripheral wall so as to provide access to a keyhole of said padlock when said cover is positioned in covering relationship with said padlock in said locked condition.

6. The padlock cover assembly as in claim 4 further comprising:

a) a first interlocking member formed on said cover and positioned such that when said cover is advanced into covering relationship with said padlock secured to said mounting bracket in an unlocked condition, said first interlocking member is positioned proximate a second interlocking member adapted to be secured to said first member such that advancement of said cover to advance said padlock to said locked condition advances said first interlocking member into interlocking relationship with said second interlocking member.

7. The padlock cover assembly as in claim 4 in combination with said padlock.

8. A padlock cover assembly for use with a padlock having a shackle and a padlock body; said assembly adapted for releasably latching and locking first and second members in cooperation with said padlock, at least one of said first and second members being moveable relative to the other; said assembly comprising:

a) a padlock mounting bracket adapted to be secured to and extend from a first member; said padlock mounting bracket having an aperture extending therethrough sized to receive said shackle of said padlock;

b) a cover including a peripheral wall and adapted to be pivotally secured to an outer surface of said second member so as to be pivotable about a first axis extending parallel to said second member outer surface and pivotable about a second axis extending transverse to said second member outer surface; said cover pivotable into and out of covering relationship with said padlock secured to said mounting bracket by said shackle extending through said aperture therein; and c) said cover having a first interlocking member secured thereto; said first interlocking member positioned on said cover such that when said cover is advanced into covering relationship with said padlock secured to said mounting bracket in an unlocked condition, said first interlocking member is positionable proximate a second interlocking member adapted to be secured to said first member and a portion of said peripheral wall of said cover is positioned adjacent a bottom of said padlock body such that pivoting of said cover about said second axis such that said portion of said peripheral wall adjacent said bottom of said padlock body is pivoted toward said padlock body advances said padlock body toward said shackle and a locked condition therewith wherein said first interlocking member is advanced into interlocking relationship with said second interlocking member to prevent advancement of said cover out of covering relationship with said padlock.

9. The padlock cover assembly as in claim 8 wherein:

a) a keyhole access opening is formed in said peripheral wall so as to provide access to a keyhole of said padlock when said cover is positioned in covering relationship with said padlock in said locked condition.

10. The padlock cover assembly as in claim 8 in combination with said padlock.

11. A padlock cover assembly for use with a padlock having a shackle and a padlock body; said assembly adapted for releasably latching and locking first and second members in cooperation with said padlock, at least one of said first and second members being moveable relative to the other; said assembly comprising:

a) a padlock mounting bracket adapted to be secured to and extend from a first member; said padlock mounting bracket having an aperture extending therethrough sized to receive said shackle of said padlock;

b) a cover including a peripheral wall and adapted to be pivotally secured to said second member so as to be pivotable about a first axis into and out of covering relationship with said padlock secured to said mounting bracket by said shackle extending through said aperture therein; said cover pivotable about a second axis extending transverse to said first axis; and c) said cover having a pawl secured to an inner surface thereof; said pawl is sized and positioned on said cover such that when said cover is advanced into covering relationship with said padlock secured to said mounting bracket in an unlocked condition, said pawl is advanced between said shackle and an upper surface of said padlock body and a portion of said peripheral wall of said cover is positioned adjacent a bottom of said padlock body such that pivoting of said cover about said second axis such that said portion of said peripheral wall adjacent said bottom of said padlock body is pivoted toward said padlock body advances said padlock body toward said shackle and a locked condition therewith wherein said pawl is advanced into interlocking relationship with said shackle to prevent advancement of said cover out of covering relationship with said padlock.

12. The padlock cover assembly as in claim 11 wherein:

a) a keyhole access opening is formed in said peripheral wall so as to provide access to a keyhole of said padlock when said cover is positioned in covering relationship with said padlock in said locked condition.

13. The padlock cover assembly as in claim 11 in combination with said padlock.

14. A padlock cover assembly for use with a padlock having a shackle and a padlock body; said assembly adapted for releasably latching and locking first and second members in cooperation with said padlock, at least one of said first and second members being moveable relative to the other; said assembly comprising:

a) a padlock mounting bracket adapted to be secured to and extend from a first member; said padlock mounting bracket having an aperture extending therethrough sized to receive said shackle of said padlock;

b) a swivel base adapted to be rotatably mounted to an outer surface of said second member and adapted to be rotatable about a first axis extending transverse to said second member outer surface;

c) a cover including a peripheral wall and pivotally secured to said swivel base so as to be pivotable about a second axis extending transverse to said first axis; said cover pivotal into and out of covering relationship with said padlock secured to said mounting bracket by said shackle extending through said aperture therein; and d) said cover having a pawl secured to an inner surface thereof; said pawl is sized and positioned on said cover such that when said cover is advanced into covering relationship with said padlock secured to said mounting bracket in an unlocked condition, said pawl is advanced between said shackle and an upper surface of said padlock body and a portion of said peripheral wall of said cover is positioned adjacent a bottom of said padlock body such that pivoting of said cover about said first axis such that said portion of said peripheral wall adjacent said bottom of said padlock body is pivoted toward said padlock body advances said padlock body toward said shackle and a locked condition therewith wherein said pawl is advanced into interlocking relationship with said shackle to prevent advancement of said cover out of covering relationship with said padlock.

15. The padlock cover assembly as in claim 14 wherein:

a) a keyhole access opening is formed in said peripheral wall so as to provide access to a keyhole of said padlock when said cover is positioned in covering relationship with said padlock in said locked condition.

16. The padlock cover assembly as in claim 14 in combination with said padlock.

* * * * *